United States Patent [19]

Valtiero

[11] Patent Number: 4,674,311

[45] Date of Patent: Jun. 23, 1987

[54] METHOD AND APPARATUS FOR AUTOMATIC SHAPING/DECORATION OF LONGITUDINAL MEMBERS IN MODULAR UNITS OF PRESET SIZE FROM WHICH ULTIMATELY TO FASHION ARTICLES OF JEWELRY IN PRECIOUS METAL AND ARTICLES OF COSTUME JEWELRY

[76] Inventor: Tizzi Valtiero, Via Clementini, 2, 47037 Rimini (Forli), Italy

[21] Appl. No.: 781,996

[22] Filed: Sep. 30, 1985

[30] Foreign Application Priority Data

Oct. 2, 1984 [IT] Italy ..... 3586 A/84

[51] Int. Cl.[4] ..... B21F 45/00

[52] U.S. Cl. ..... 72/68; 72/69; 72/420

[58] Field of Search ..... 72/68, 69, 78, 77, 420, 72/421; 57/16

[56] References Cited

U.S. PATENT DOCUMENTS

| | | | |
|---|---|---|---|
| 415,880 | 11/1889 | Patt | 72/78 |
| 581,459 | 4/1897 | Goddu | 72/78 |
| 1,386,156 | 8/1921 | Butterfield | 72/78 |
| 2,160,268 | 5/1939 | Hunter et al. | 72/78 |
| 2,431,863 | 12/1947 | Clifford | 72/69 |

*Primary Examiner*—Lowell A. Larson

*Attorney, Agent, or Firm*—Birch, Stewart, Kolasch & Birch

[57] ABSTRACT

A method and apparatus for automatic shaping and/or decoration of longitudinal members in modular units of preset size, such as wire, tube, flat strip or linked pressings, from which ultimately to fashion articles of jewelry in precious metal or articles of costume jewelry, featuring the following steps: two-point support, tensioning and guiding of a longitudinal member through and along its own longitudinal axis; shaping/decoration of a stretch of the longitudinal member lying between the supports, at points located in opposition either side of a longitudinal median plane; and linear and/or rotational movement of the longitudinal member along and/or about its own longitudinal axis relative to means which carry out such shaping or decoration.

19 Claims, 23 Drawing Figures

91
27
89
90
32
13
83
84
81
85
92
93
23
82
80
63
51
31
12
63
63
93
111
107
108
33
112
109
19
7b
110
7a
76
77
A
79
18
24
70
113
78
7
30
15
22
29
22
73
71
74
72
75
21
63a
25
63
19
51
24
64
65
64
1
24
66
19

141
11
140
144
142
150
151
154
146
128
152
15
149
137a
153
147
148
69
17a
14a
67
95
127
14
145
22
75
134
21
130
131
129
133
127
137
135
136
132
155
143
8
138
139

FIG5
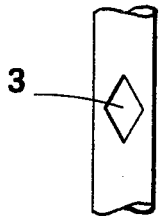
FIG6
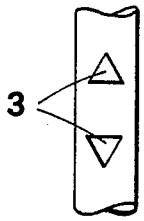
FIG7
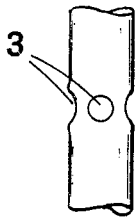
FIG8
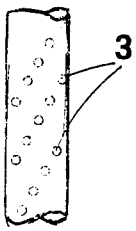
FIG9
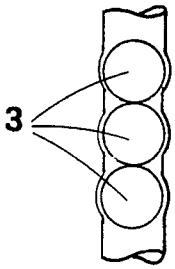
FIG10a
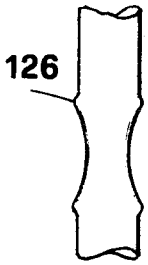
FIG10b
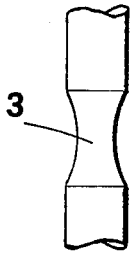
FIG11a
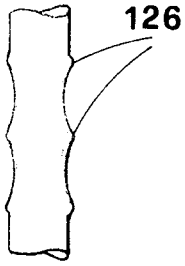
FIG11b
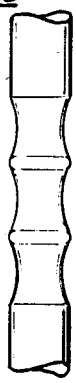
FIG12a
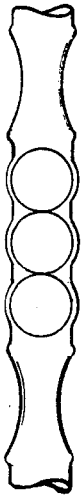
FIG12b
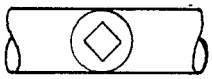
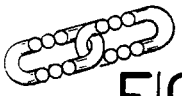
FIG13
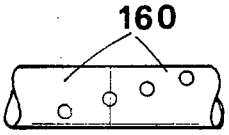
FIG14

METHOD AND APPARATUS FOR AUTOMATIC SHAPING/DECORATION OF LONGITUDINAL MEMBERS IN MODULAR UNITS OF PRESET SIZE FROM WHICH ULTIMATELY TO FASHION ARTICLES OF JEWELRY IN PRECIOUS METAL AND ARTICLES OF COSTUME JEWELRY

BACKGROUND OF THE INVENTION

The invention relates to a method and to apparatus for automatic shaping/decoration of longitudinal members into and/or in modular units of preset size from which articles of jewelry in precious metal and articles of costume jewelry are ultimately fashioned, for instance, units such as links and/or matching half-links for chains.

The art field to which the disclosure is directed is that embracing automatic machinery used in the manufacture of articles of jewelry, whether precious metal or costume jewelry, such as chains fashioned from links, or matching half-links, or other similar items.

Such articles are obtained currently from wire or tube having a constant cross section, using automatic machines which turn out pieces of a simple and easily repeatable nature, such as links that may be connected one with the next to form a chain.

The method employed with automatic machines of the type in manufacturing, say, chain links, is one of cutting a continuous wire of constant section into lengths corresponding to the single link, and/or cutting lengths from a helicoid, and then forming the chain; finally the outer surface of the chain thus formed is decorated.

It will be clear, however, that the number of decorative effects applicable to the chain using such a method is extremely limited, since in articles with links already connected it is extremely difficult, if not impossible, to decorate on the inside face of the wire, an option which would permit of producing other and more pleasing designs on the link, hence on the chain as a whole.

Extensive and taxing research has led the applicant to the invention as disclosed herein, the object in view being that of providing a method and an apparatus capable of creating pre-decorated (or semi-finished) longitudinal members automatically, in optimum fashion and as may be most advantageous, and without any need for means of supporting the wire at the point where means for carrying out the shaping and/or decoration operations are located.

A further object of the invention is that of providing an apparatus, compatible with the foregoing object, designed to exert pressures on the wire which balance each other in such a way as to leave the wire itself, axially tensioned, otherwise undisturbed.

Another object of the invention is that of providing a method and apparatus compatible with the above objects, which will permit of applying decoration even to longitudinal members of limited thickness whether these be solid or hollow, and whatever may be the cross section of such members.

Yet another object of the invention is that of providing a method and apparatus compatible with the above objects, and such that shaping operations can be carried out either by molding or by machining-away of the material in question.

Finally, it is an object of the invention to provide a method and apparatus compatible with the above objects, such as will permit of crafting longitudinal members in modular units of preset size, with positive or negative impressions and of varying cross section, designed for synchronized operation with one or more automatic machines used in production of the finished article.

SUMMARY OF THE INVENTION

The objects thus stated are realized with the disclosed method for automatic shaping/decoration of longitudinal members in modular units of preset size from which ultimately to fashion articles of jewelry in precious metal or articles of costume jewelry, an essential feature of which is that it comprises the following steps:

(a) support, tensioning and guiding of the longitudinal member through and along its own longitudinal axis;

(b) shaping/decoration of the longitudinal member at or along successive stretches thereof lying between the supports, at points located in opposition either side of a longitudinal median plane, or at all events, spaced apart through equal angular distances relative to the longitudinal axis of the member;

(c) linear and/or rotational movement of the longitudinal member along and/or about its own longitudinal axis relative to means which carry out such shaping/decoration; the member being held in position with respect to such shaping/decoration means, by the means themselves.

Similarly, the stated objects are realized with apparatus as disclosed, essential features of which are:

that it comprises: means of supporting, tensioning and guiding the longitudinal member; means of shaping and/or decoration acting simultaneously on the longitudinal member at points located in opposition either side of a longitudinal median plane, or at all events spaced apart through equal angular distances relative to the longitudinal axis of the member; means for producing linear and/or rotational movement of the longitudinal member along and/or about its longitudinal axis relative to the shaping/decoration means; means of control designed to draw and distance the shaping/decoration means closer to and farther from the longitudinal member synchronously with the means for producing relative movement and according to the thickness of the longitudinal member and/or to the depth of the shaped or decorated effect; and that the guide means are located at either side of and immediately adjacent to the shaping/decoration means.

An apparatus thus embodied offers a number of singularly important advantages, for example, the inclusion of shaping/decoration means which are located in opposition, or at least, disposed in such a way as to avoid subjecting the axially-tensioned longitudinal member to any extra pressure during operation; in this way one dispenses with the need for supports working in concert with such means of shaping and/or decoration.

Another advantage is that of being able to decorate producing positive or negative impressions in the initial longitudinal member, working to the limit of minimum residual gauge values and creating any design whatever, before the member is cut into modular sections of the preset length.

A further advantage of the apparatus is the option that it provides of decoration producing positive or negative impressions at any points along the longitudinal member, whether regularly spaced apart or otherwise, such that a first decoration may first be produced for a given type of link, followed by a further decoration for another given type of link or half-link, and so forth.

The fact that the longitudinal member is able to rotate in relation to the means for carrying out decoration, or viceversa, brings the not inconsiderable advantage of having a facility for the creation of decorations following a helicoid pattern coaxial with the longitudinal member.

The foregoing signifies that an apparatus according to the invention can produce decoration with positive or negative impressions not only on the outer surface but on the inside face of chain links; this has never been possible hitherto since the tools utilized would have to be of miniscule dimensions in order to reach the inside face of a link already closed and forming part of an assembled chain.

Particular advantage is gained in the stages following shaping/decoration of the longitudinal member, from the use of a controlled atmosphere oven and of supply and take-up reels, first, because one avoids oxidation on the longitudinal member, which must exhibit a specular finish, and second, because the longitudinal member is freed to an extent from the effects of work-hardening induced beforehand by deformation (if shaping has taken place) and can be recoiled without remaining permanently deformed at the thinnest points and causing all of the accurate settings made to the apparatus, and the faultless decorations produced on the longitudinal member, to be set at nothing.

A further, marked advantage regarding another feature of the apparatus disclosed is afforded by providing an interchangeable tool magazine for means which carry out the shaping/decorating operations. In this way one can produce different decorative effects with the one apparatus, simply by changing over from one magazine to another.

The range of possibilities offered by the apparatus is made still wider by another feature; the facility of having a number of work stations arranged in series permits of performing a succession of shaping or machining operations on the one longitudinal member. Such operations may be regularly indexed or repeated and/or identical, or not.

Finally, the special structure of apparatus according to the disclosure is such as to permit of crafting any type of longitudinal member, whether wire, or tube, or flat sections, or pre-assembled chain pressings.

BRIEF DESCRIPTION OF THE DRAWINGS

The method and apparatus to which the invention relates will now be described in detail by way of example with the aid of the accompanying drawings, in which:

FIGS. 5–9 show certain of the decorative effects obtainable with apparatus as in FIGS. 2*b* and 3*a*;

FIGS. 10*a* and 11*a* show certain of the decorative effects obtainable with apparatus as in FIG. 3*b*;

FIGS. 10*b* and 11*b* show certain of the decorative effects obtainable with apparatus as in FIG. 3*d*;

FIGS. 12*a* and 12*b* show examples of decorative effects which can be obtained with an apparatus that combines apparatus as in FIGS. 3*a* and 3*b* with apparatus as in FIG. 3*c* and FIG. 3*a*, respectively;

FIG. 13 shows a pair of links fashioned from wire as in FIG. 9;

FIG. 14 shows the detail of a link with a decorative effect produced by apparatus as in FIGS. 3*a* or 3*c*.

DESCRIPTION OF THE PREFERRED EMBODIMENTS

Figure 1A:
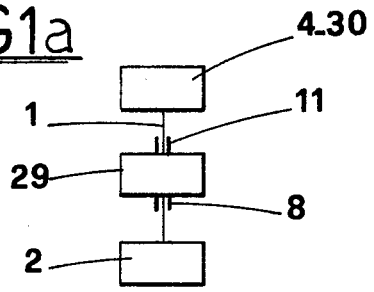
FIGS. 1*a* and 1*b* are respective general and detailed block diagrams which illustrate the method disclosed.

With reference to FIG. 1*a*, which is a block diagram illustrating the method disclosed, it will be observed that the following stages are envisaged:

(a) support, tensioning and guiding of a longitudinal member 1 through and along its own longitudinal axis;

(b) shaping/decoration of the longitudinal member 1 at or along successive stretches thereof lying between the supports, by tools operating simultaneously and positioned either side of or around the longitudinal axis of the member 1;

(c) linear and/or rotational movement of the longitudinal member 1 along and/or about its own longitudinal axis relative to means which perform such shaping-/decoration operations.

In FIG. 1*a*, blocks 4–30 and 2 denote stations providing for support and tensioning of the longitudinal member. 29 denotes the shaping and/or decoration station; 8 and 11 are guides.

Stations producing the relative linear and/or rotational movement as in point c are not illustrated since it is well within the scope of the invention either to move the relevant station 29 while the longitudinal member 1 is maintained stationary, or to move the longitudinal member 1 while the station 29 is maintained stationary, or again, to invest the station 29 with either linear or rotary movement, and the longitudinal member 1 with rotary or linear movement correspondingly.

Likewise in FIG. 1*a*, the guides 8 and 11 are shown in close proximity to the station denoted 29 since, in accodance with an essential feature of the invention, this is their effective position.

When carried into effect, the method might exist in a number of different versions, all of which fall within the scope of protection sought herein.

Figure 1B:
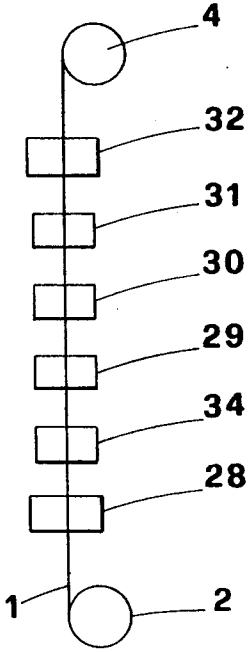

For example, the block diagram in FIG. 1*b* is one illustrating the same method applied specifically to the shaping/decoration of a continuous type of longitudinal member 1 available in coils, wound onto interchangeable reels.

As the diagram of FIG. 1*b* illustrates, the method is one whereby a longitudinal member 1, which might be a wire, a flat strip, or a tube, in annealed state, is wound off an interchangeable supply reel 2 and fed through a series of stations 28, 29, 30, 31 and 32. First, the member 1 is straightened (station 28) then crafted in whatever fashion may be selected, say, shaping by deformation, or by cutting or milling away material, and perhaps becoming slightly work-hardened in the process (station 29), guided and tensioned (station 30), oven-tempered in a controlled atmosphere (station 31), perhaps gauged (station 32), then recoiled onto an interchangeable take-up reel 4.

Although tensioning is brought about at the station denoted 30, the longitudinal member 1 is already taut between the supply reel 2 and the station 30 itself, especially on passing through the shaping/decoration stretch (station 29). Gauging (station 32) might equally well take place at some point in the process following recoil onto the take-up reel 4.

Still with reference to FIG. 1*b*, 34 denotes an intermittent wire feed drive unit located between the straightening station 28 and the shaping/decoration station 29.

Like the method and its different versions, the apparatus might clearly exist in a number of different embodiments whilst by no means straying from within the scope of the disclosure. The following specification is drawn up with reference to FIGS. 2*a*, 2*b*, 2*c*, 3*a*, 3*b*, 3*c* and 4, which show one such embodiment of apparatus, with variations, for the shaping/decoration of a longitudinal member; and embodiment illustrated is continuous in operation, and has means for producing linear and rotational movement.

Figure 2C:
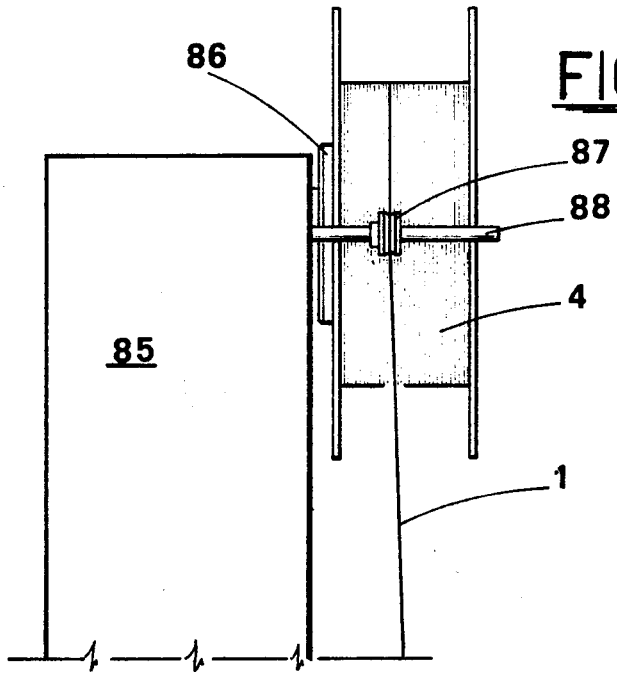
FIGS. 2*a*, 2*b* and 2*c* are separate elevations illustrating the apparatus in its entirety.
Figure 2A:
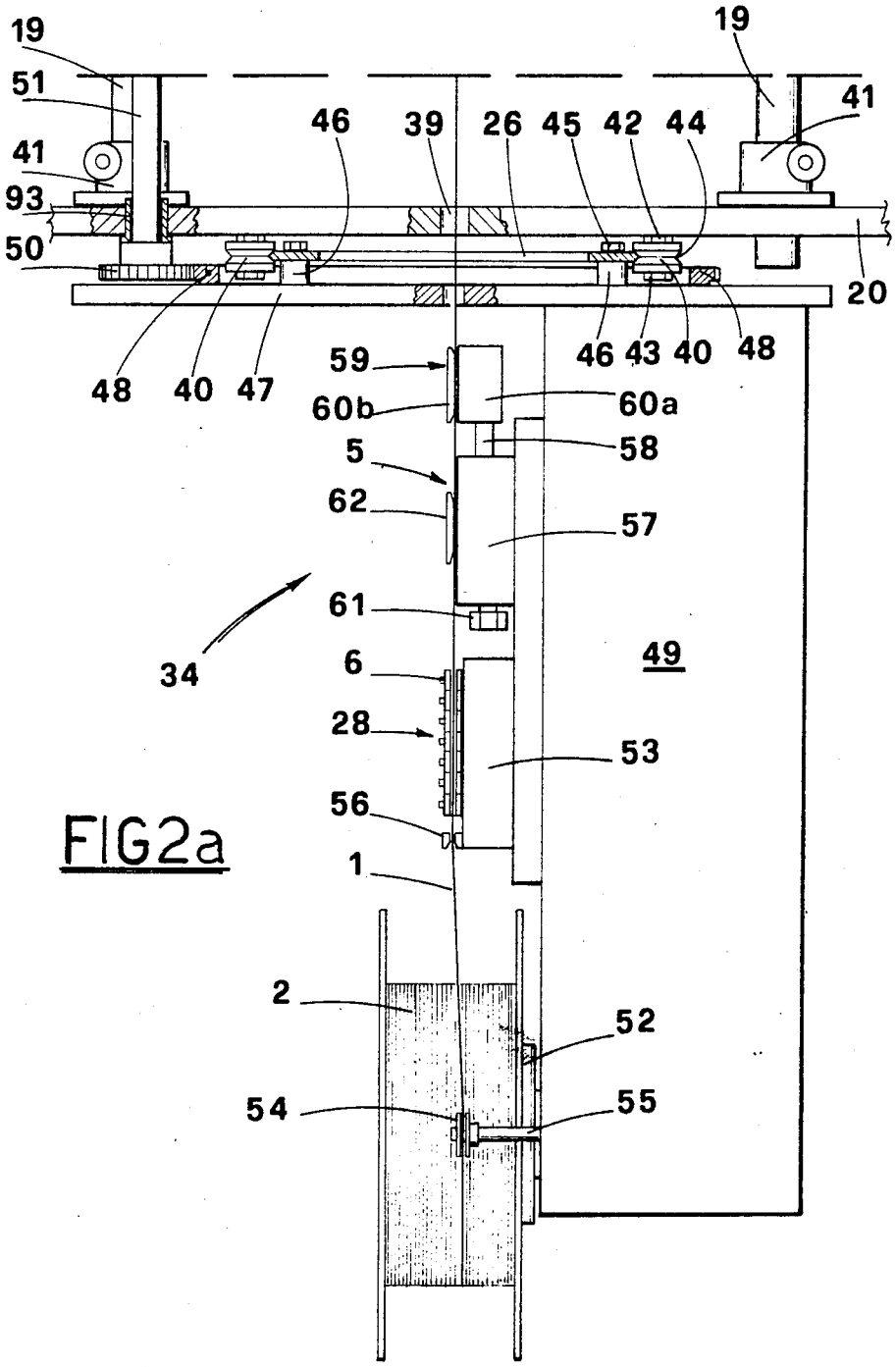
Figure 2B:
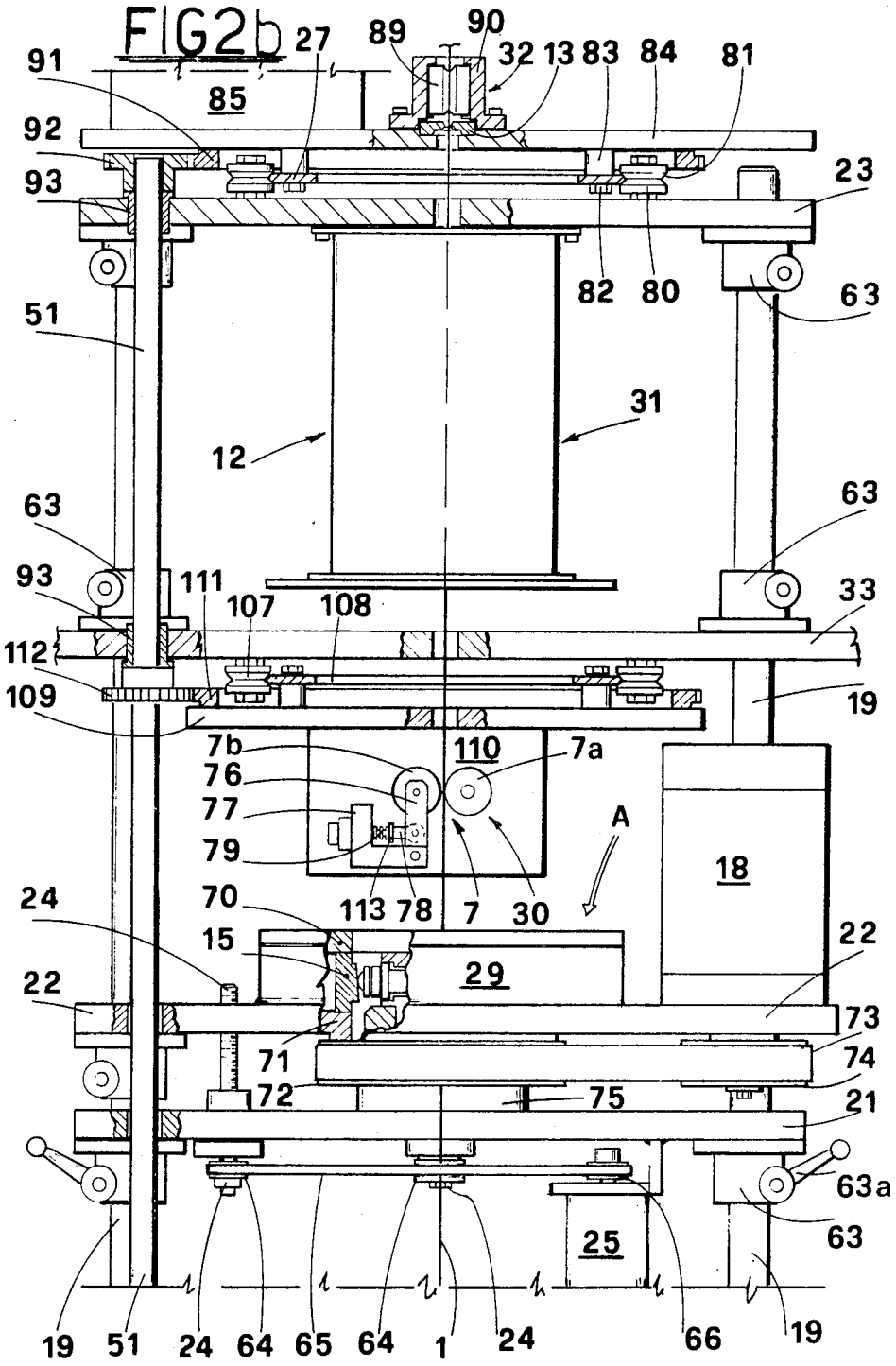

Referring to FIGS. 2*a*, 2*b* and 2*c*, it will be seen how the entire apparatus rests on a framework of which only a plate 20 is illustrated in the interests of simplicity. Likewise for reasons of simplicity, the longitudinal member 1 is referred to as a wire, though the cross section of such a member could be one of practically any: constant or otherwise, round or polygonal or other, solid or hollow, or the member itself could be an assembled chain.

39 denotes a hole located centrally in the plate 20, and 40 denotes a set of idle rollers which turn on respective spindles issuing from the bottom of the plate. Mountings 41 located on the top side of the plate provide support for respective pillars 19.

The idle rollers 40, positioned and retained on their relative spindles by respective lock nuts 42 and 43, each exhibit a groove 44, and are distributed at points around a common circumference. The grooves 44 of these rollers 40 engage with the corresponding molded edge of a flat circular ring 26 in such a way that the ring 26 is supported by the rollers 40 and free to rotate thus.

47 denotes a plate fastened to the underside of the ring 26 with bolts 45 and distance collars 46, and exhibiting an axial hole. Attached to the top of this bolted plate 47 one has a rim gear 48, and to the bottom, a body denoted 49. The gear 48, which is in effect an annular slewing ring, lies outside the circumference described by the set of idle rollers 40 and meshes with a pinion 50 keyed to a relative drive shaft 51; the function of this gear will become clear in due course.

Working up from the bottom of FIG. 2*a*, the body 49 carries the interchangeable supply reel 2, fitted by way of a clutch 52, a set of straightening rolls 6 mounted by way of a base 53, and an intermittent wire feed drive unit 5 that responds only to a specific control signal.

The wire 1 to be crafted is coiled around the supply reel 2, and the body 49, supports a guide roller 54 which is freely rotatable on a spindle 55 that is able to move through an axial path parallel with the axis of the supply reel 2. Movement of the spindle 55 is such as to ensure that the roller 54 keeps the wire 1 substantially normal to the axis of the supply reel 2 as it is gradually uncoiled and paid out.

The base 53 of the straightening station is provided with an alignment gate 56 which ensures that the wire 1 is run into the straightening rolls 6 at a constant trajectory, regardless of the position at which the wire 1 is paying out from the reel 2.

The intermittent wire feed drive unit 5 is pneumatically operated, and consists basically of a cylinder 57 fixed to the body 49, from which a rod 58 is caused to extend; the top end of the rod is fitted with a grips-mechanism 59, and a nut 61 fitted to the bottom end provides for adjustment of the stroke. The grips-mechanism 59 comprises a first element 60*a* integral with the rod 58, and an element 60*b* which is movable relative to the first through a direction normal to the rod 58. The cylinder, together with a guide 62, and the first element 60*a*, also perform the function of guides which direct the wire 1 along the path assumed on exit from the straightening rolls 6.

The pillars 19 pass right through the mountings 41, which afford support by way of a clamping action that permits of making adjustments in height. The pillars 19 in fact pass right through the plate 20 beneath, and through a series of plates 21, 22, 33 and 23 above, the four last-mentioned being located at given positions on the pillars 19 and locked thus by clamps 63 which may be provided with handles 63*a*.

The plate denoted 21, bottom-most of the four in question, accommodates a set of three calibrated micrometric screws 24 which are free to turn therein but permitted no axial slide relative thereto. The threads of the three screws 24 engage in the plate 22 next upward, whilst the bottom ends of the screws are integral with respective pulleys 64 which engage a timing belt 65; the belt is looped around a driving pulley 66, identical to the driven pulleys 64 and keyed to the shaft of a motor 25 fixed to the underside of the plate 21.

The plate denoted 22 is provided with an axial hole, and is integral with a ring 67 (see FIGS. 3*a* and 3*b*) which supports a cam ring 15 by way of a bearing 68. The internal surface of the cam ring 15 is tapered, the reason for which will become clear, and exhibits a given shape through all planes normal to its axis, for a further reason which will likewise be made clear. The bearing 68 will allow the cam ring 15 to rotate with respect to the support ring 67, but not to shift axially relative thereto. 69, 70 and 71 denote fittings the first of which 69 locks the bearing 68 to the support ring 67, and the remaining two of which, top 70 and bottom 71, lock the bearing 68 to the cam ring 15.

The bottom fitting 71 is integral with a pulley 72 driven by a timing belt 73, which in turn passes around a similar pulley 74 keyed to the shaft of a motor 18 mounted to the plate 22.

14 denotes a tool magazine located internally of the cam ring 15, which is interchangeable and sits on an annular rest 75 integral with the plate 21 beneath. Two cam followers 94 project in diametrically opposed directions from the tool magazine 14 (see FIGS. 3*a* and 3*b*), and have ball ends 95 which locate on the inner surface 17 of the cam ring 15. The two cam followers 94 slide axially within corresponding bores 96 located in diametrical opposition in the tool magazine 14; each cam follower 94 exhibits an enlarged annular section 97 slidable within a corresponding enlargement of the relative bore 96. The cam followers 94 are biased by respective coil springs 98 which urge against the enlarged annular section 97 on the one side, and against the bottom of a small seating provided in each bore 96 for the relative spring 98. The bores 96 in the tool magazine 14 are illustrated in diametrical opposition on the assumption that the wire 1 will be indexed forward intermittently. Where feed is continuous, the bores must be angled relative to the axis of the wire 1 in the direction of movement of the wire itself. The tool magazine 14 is provided with an axial hole which accommodates a bottom guide 8 and a top guide 11 the inner ends of which communicate with the diametrical bore passage.

The position of the guides 8 and 11, which are in the form of bushes, follows the line established by the alignment gate 56 and straightening rolls 56, and the cylinder 57 with its guide 62 and grips mechanism 59.

The plate denoted 33 is identical in terms of construction to plate 20; its underside carries idle rollers 107 which support a flat ring 108, a bolted plate 109 with an axial hole, and a vertical bracket 110 supporting a pair of guide rollers 7. The plate denoted 109 is integral with a rim gear 111 located outside the circumference defined by the rollers 107, which meshes with a pinion 112 keyed to a drive shaft 51. Of the pair of guide rollers 7, one roller *7a* is maintained in a fixed axial position, whereas the other *7b* is movable through a path parallel with its own axis. The fixed position roller *7a* is driven by a motor (not illustrated), whilst the movable roller *7b* turns idle between the ends of a pair of parallel arms 76 the remaining ends of which are hinged to a mounting 77. A hole in this mounting 77 accommodates a spring loaded rod 78 having its outer end hinged to the parallel arms at mid-point therealong; 79 denotes the spring. By urging against a locating surface (not illustrated) on the mounting 77, and against an enlarged section 113 of the rod 78, the spring ensures that the movable roller *7b* is maintained in constant contact with the fixed position roller *7a*. The pair of rollers 7 will be arranged such as to tension the wire 1 through the path established by the alignment gate 56 and straightening rolls 6, the cylinder 57 with its guide 62 and grips mechanism 59, and the guides 8 and 11.

The top-most plate 23 carries an underslung oven 12 featuring continuous operation in controlled atmosphere, which provides for heat treatment of the wire 1 by tempering. The top side of this plate 23 substantially mirrors the arrangement of the underside of the plate 20—i.e., a set of idle rollers 80 each having a groove 81 engaging the outer molded edge of a flat ring 27, and a plate 84 with a central hole made fast to the top of the ring 27 via bolts 82 and distance collars 83.

The bolted plate 84 carries a body 85, this in turn supporting the interchangeable take-up reel 4 which is driven by a motor (not illutsrated) and a clutch 86 producing higher torque than the clutch 52 operating the supply reel 2. Like the supply end, the take-up body 85 incorporates a guide roller 87 freely rotatable on a spindle 88 to ensure that the wire 1 runs substantially normal to the axis of the take-up reel 4 as it is gradually recoiled. Also fitted to the top of the bolted plate 84 and coaxial therewith, one has a wire-drawing station 13 designed to restore the wire 1 to its maximum section or diameter, and a pair of guide rollers in tangential contact with the wire, which turn in respective mountings 90.

A rim gear 91 integral with the underside of the bolted plate 84 meshes with a pinion 92 keyed to the drive shaft 51. The drive shaft 51 passes through plates 21 and 22 without contact, turning in journal bearings 93 provided in plates 20, 23 and 33, and is turned by a conventional drive system not illustrated in the drawings.

With specific reference to FIGS. *2b* and *3a*, which illustrate a first embodiment of the apparatus, it will be seen that the end of each cam follower 94 innermost in the tool magazine 14 carries a punch 9 of any given shape or type.

The drawings show one pair either of multiple punches 9, shaping rollers 10, cutters 122 or turning tools 151 by way of example; in practical application however, several pairs of such tools might be fitted in order to permit of producing more complex types of decoration, as will be seen in due course. Morover, the tools need not necessarily be utilized in pairs, but may be used in groups of, perhaps, three or five, provided that the angular distance between them is equal, thereby ensuring that the wire 1 is subjected to a perfectly balanced pressure and the only strain is axial, and that they operate simultaneously.

Figure 4:
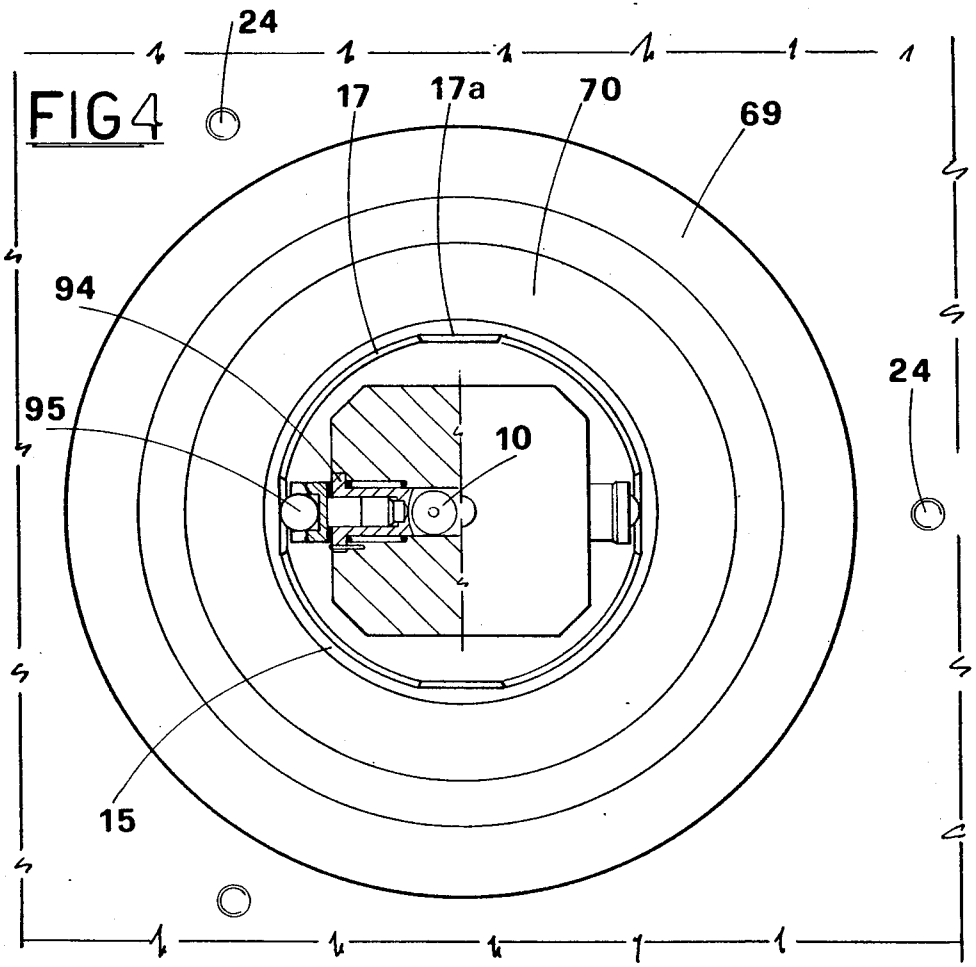
FIG. 4 is a part of the apparatus shown in FIG. 3*b*, seen partly in plan and partly in section.

With reference to FIG. *3b*, and to the plan of FIG. 4, it will be observed that the bottom guide 8 is much elongated, and integral with the tool magazine rest 75, which is no longer annular. A recessed component 99 keyed to the top of the guide 8 is provided with internal gear teeth 100 that mesh with two gears 101 the purpose of which will become apparent in due course.

The inner end of each cam follower 94 lying within the tool magazine 14 terminates in a clevis; each clevis supports a spindle to which a shaping roller 10 is keyed, embraced by the clevis yoke, and to which a relative gear 101 is likewise keyed, in this case underhung from the clevis.

The rest 75 associates, by way of a pair of bearings 102 and a distance sleeve 103, with a cylindrical body 104 which encircles it, and connects with the tool magazine 14 whilst remaining interchangeable with respect thereto; in this embodiment, the tool magazine 14 sits on the rest 75 by way of one of the bearings 102 and is thus able to rotate freely thereon. A pulley 105 integral with the bottom end of the cylindrical body 104 pairs with a timing belt 106 which, in its turn, passes around the pulley 74 keyed to the shaft of the motor 18 aforementioned. In this embodiment, both of pulleys 72 and 105 are driven by this motor 18; the two pulleys have dissimilar diameters however, such that the magazine 14 will rotate at a slower speed than that of the cam ring 15. In rotating the tool magazine 14, the tool gears 101 likewise are caused to rotate about the axis of the tool magazine 14, and in consequence, the gears 101 rotate about their own axes, meshing as they do with the internal gear teeth 100 of the recessed component 99, which is integral with plate 21 below and thus stationary. Furthermore, the teeth of the gears 101 and the internal teeth 100 of the recessed body 99 are of length such as to remain in constant mesh even when the shaping rolls 10 are drawn together during rolling, or drawn apart following adjustment of the tool magazine 14 relative to the cam ring 15 in order to accommodate different gauges of wire 1.

FIG. *3c* illustrates a third embodiment of the apparatus, wherein it will be observed that the top of the tool magazine 14 is integral with a circular plate 114 greater in diameter than the ring 67. In addition, at least one pair of opposed vertical components is hinged at bottom to the tool magazine 14 so as to swing through a vertical plane coincident with the axis of same. Each vertical component 115 accommodates the cam follower 94 at a point intermediate thereon, and is provided with a return spring 116 at a point farther above which counteracts the centripetal force exerted by the cam follower 94. The uppermost extremity of each component 115 carries a cutter spindle 117 rotated by a belt and pulley drive 118, 119 and 120, the power for which originates from a respective motor unit 121 mounted to the circular plate 114. Each spindle 117 carries a respective cutter 122, and the assembly of cutters 122 will be arranged such that pressures exerted on the wire 1 are balanced, and the wire itself remains perfectly motionless. In this embodiment, the bottom guide 8 is considerably elongated so as to reach nearly up to the cutters and thus ensure accurate alignment of the wire 1, whereas the top guide 11 is integral with a casing 123 carried by the circular plate 114. An annular extractor duct 124 is located adjacent and encircling the top guide 11 for the purpose of removing waste from inside the casing, above all from the area immediately around the cutters 122 and the wire 1. The circular plate 114 also carries a circular guard 125 which shields the fitting denoted 69 and prevents infiltration of dirt that might foul the cutters 122.

Figure 3A:
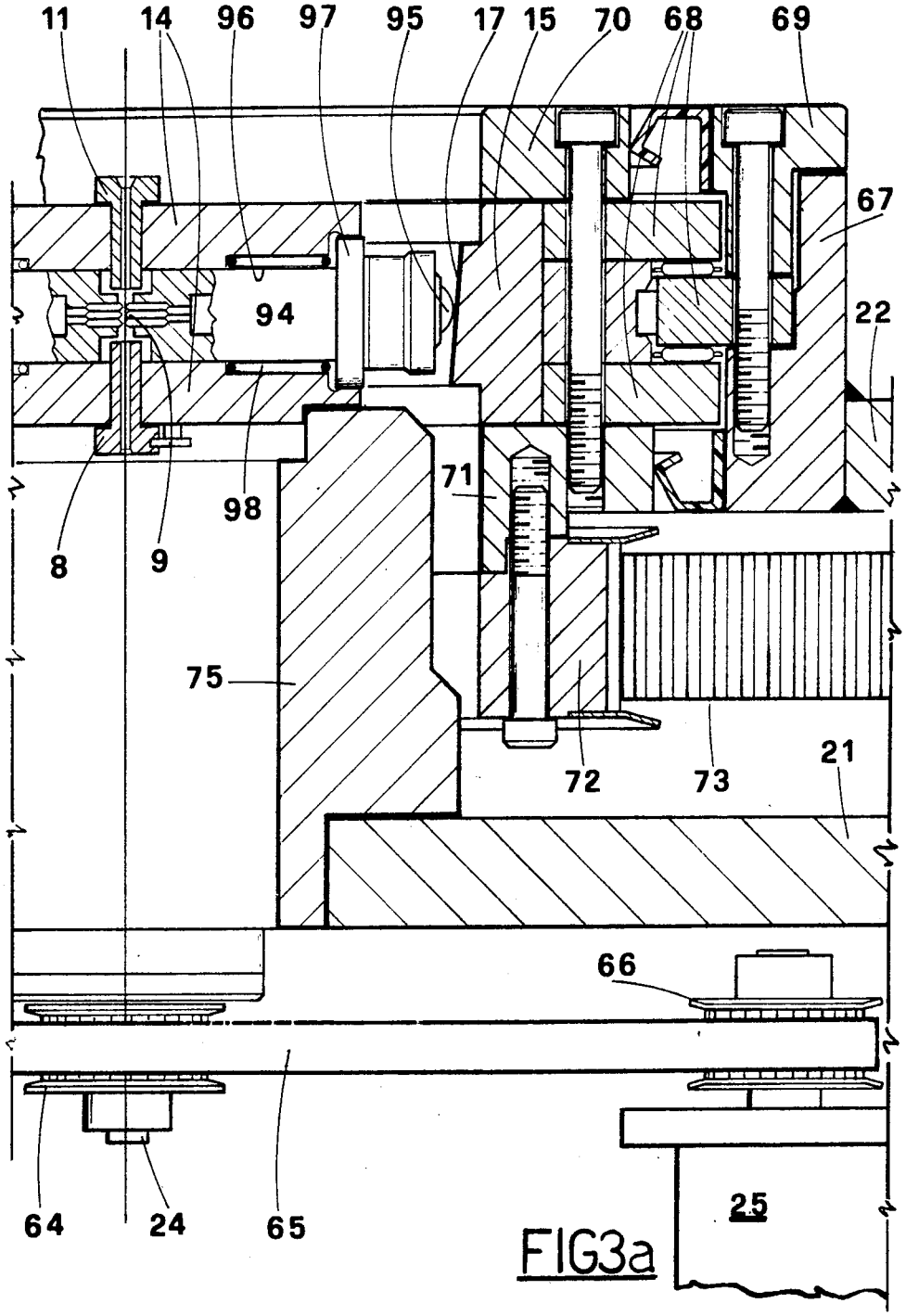
FIGS. 3*a*, 3*b*, 3*c* and 3*d* are large scale illustrations showing different embodiments of part A in FIG. 2*b*.
Figure 3B:
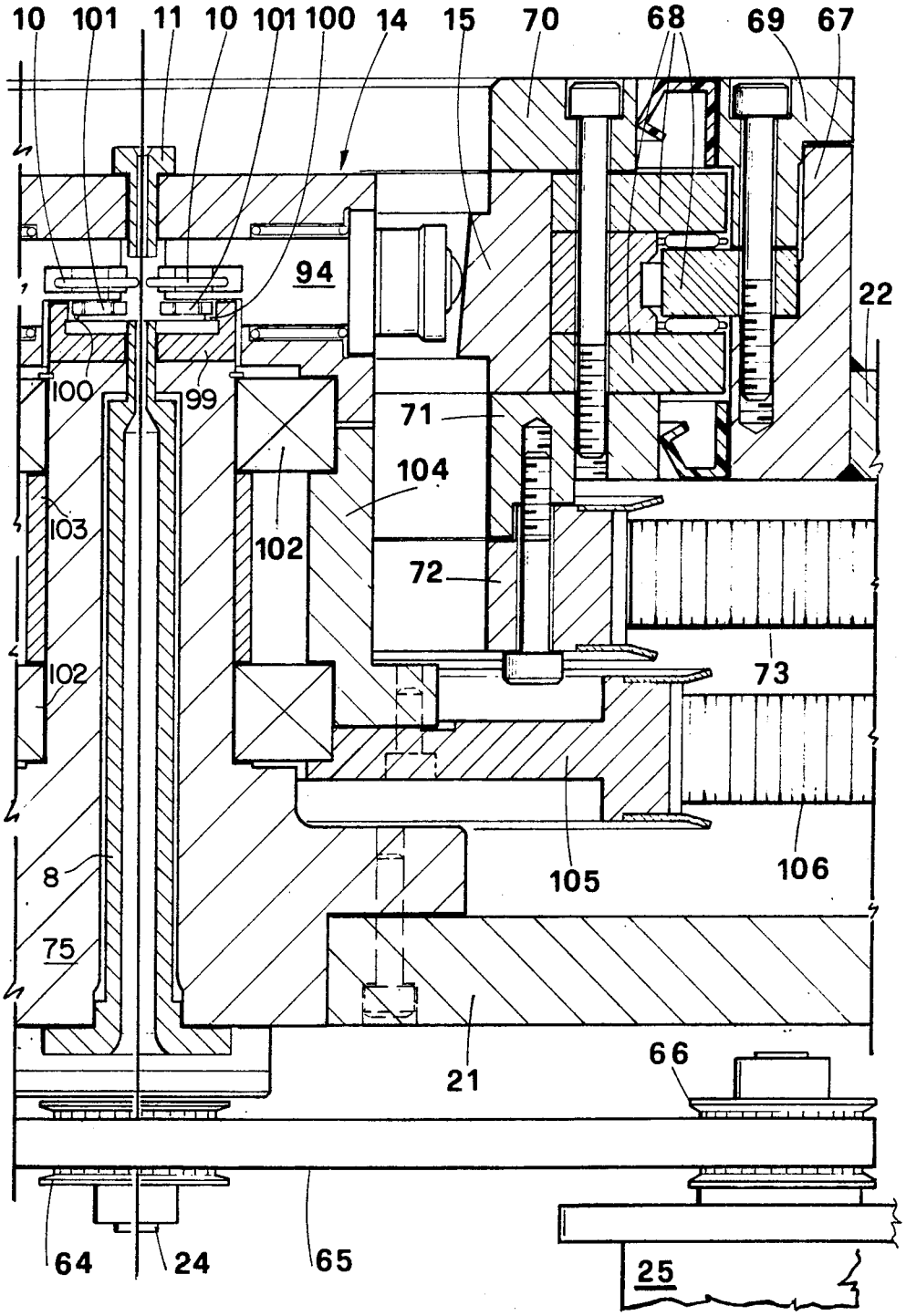
Figure 3C:
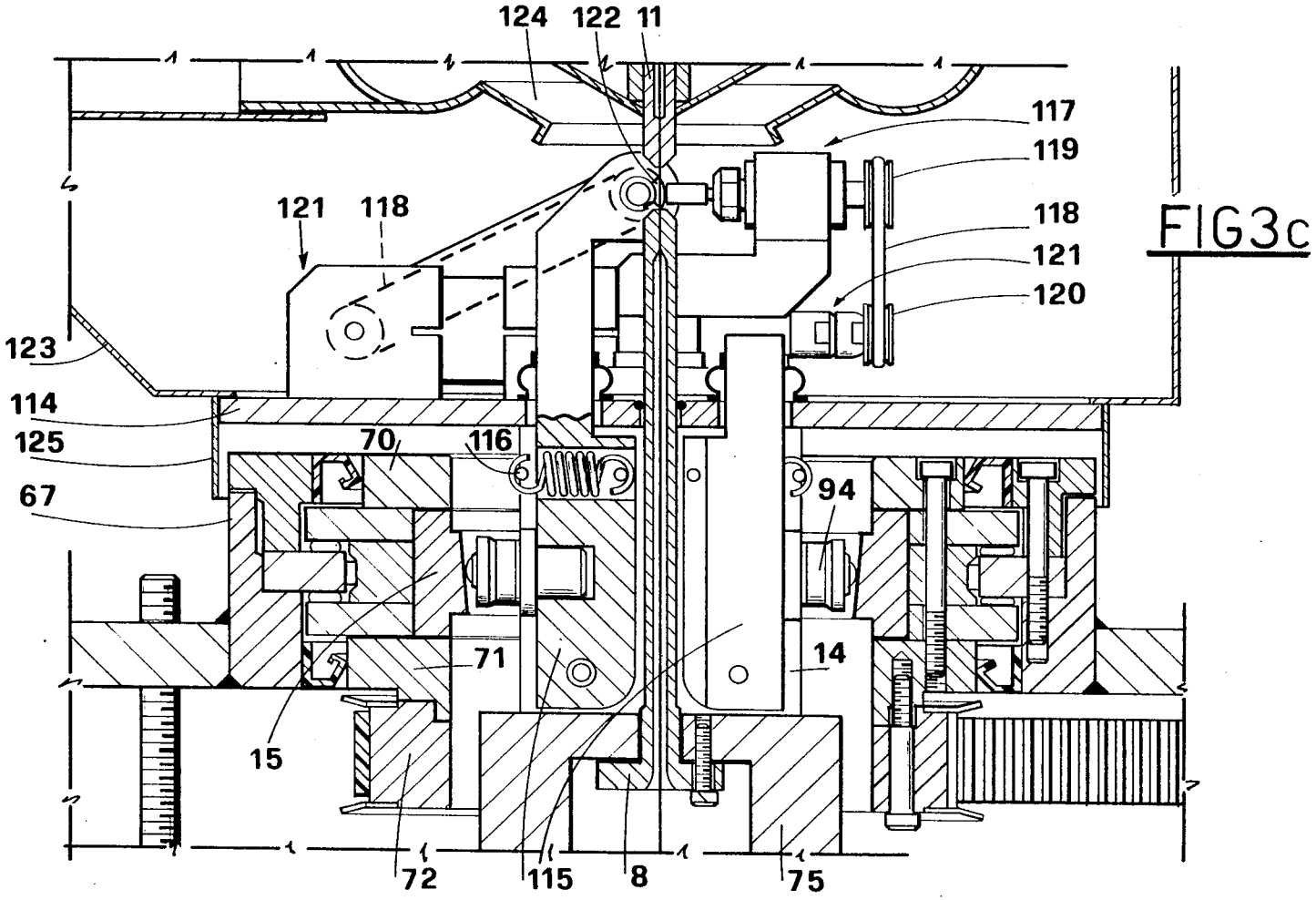
Figure 3D:
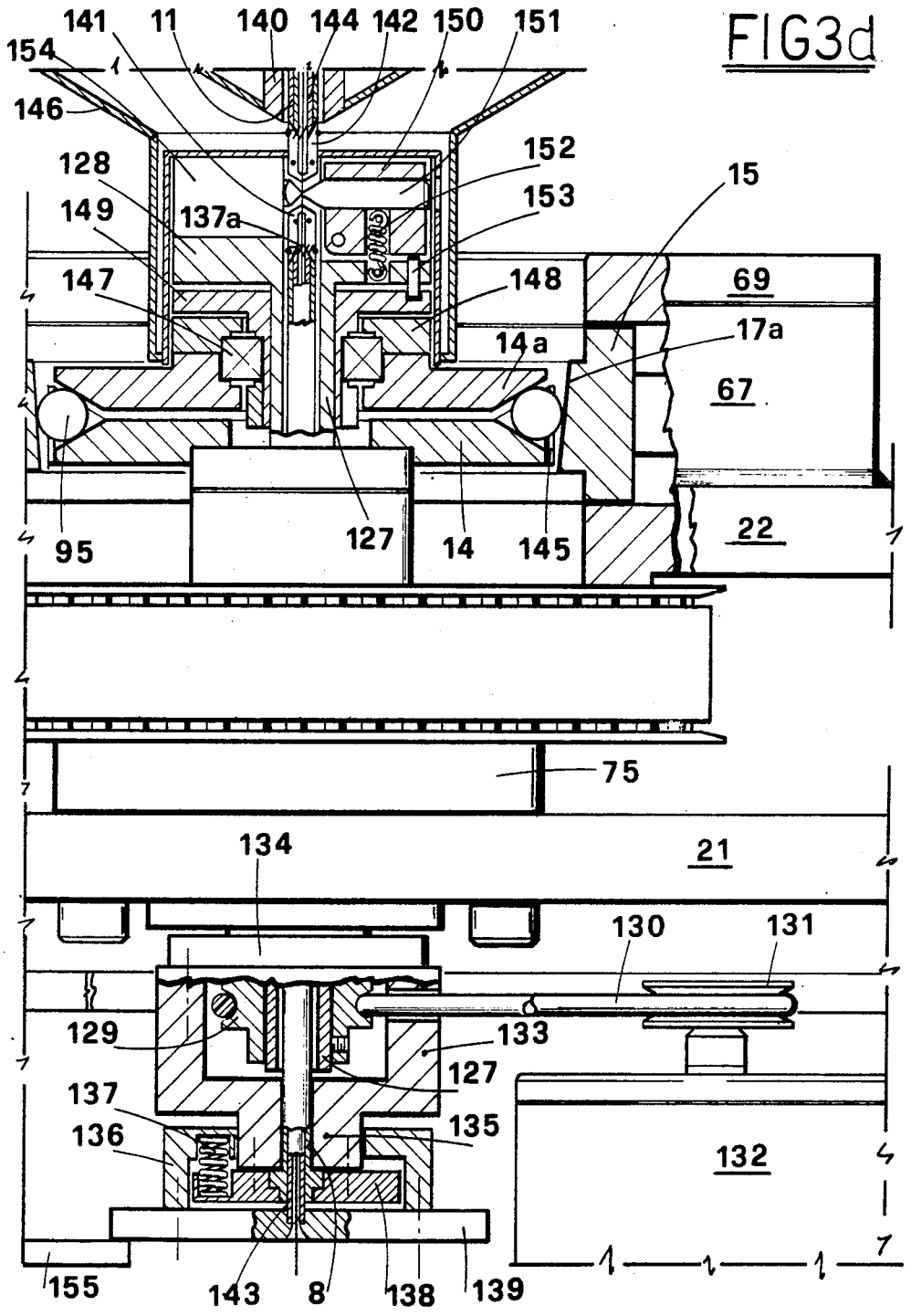

With reference to the embodiment in FIG. 3*d*, it will be seen that the tool magazine rest 75 accommodates and supports a first vertical tube 127 the top end of which is integral with a flange 128. The bottom end of this first tube carries a keyed pulley 129 pairing with a belt 130 which in its turn passes around a drive pulley 131 keyed to the shaft of a motor 132. The bottom end in question is enclosed within a recessed component 133, this in turn being locked to a clamp plate 134 made fast to the tool magazine rest 75. The recessed component 133 is provided with a lateral hole affording passage to the drive belt 130, and exhibits a cylindrical spigot 135 at bottom ensheathed by the converging top edge of a first cylindrical ring 136. The top edge of the first ring 136 is provided with seats for coil springs 137 the remaining ends of which locate in corresponding seats offered by a plate 138 integral with the bottom end of the cylindrical spigot 135. In the embodiment in question, the opposed ends of the bottom and top guides 8 and 11 carry hinged sets of grips, denoted 141 and 142 respectively, operated by way of relative cylindrical control sleeves 143 and 144 which slide axially within the respective guides 8 and 11. The wire 1 is threaded through these control sleeves, so that the sleeves themselves act as guides. The bottom ends of the guide 8 and its control sleeve 143 are made absolutely fast to the respective plates 138 and 139, the latter plate being integral with the bottom edge of the first cylindrical ring 136, and moving as one therewith in consequence. The top guide and its grips 11 associates with an assembly (not illustrated for the sake of simplicity) which mirrors that of the recessed component 133, cylindrical ring 136, springs 137, and plates 138 and 139. Instead of the component denoted 133, one has a second tube 140 integral with a spigot similar to that denoted 135, and mounted to an annular extractor duct 146 fixed to the pillars 19 (not visible in FIG. 3*d*). The tool magazine 14 is connected to the rest 75, and is flat, with a conical surface on which balls 95 are able to run while at the same following the tapered surface 17 of the cam ring 15; the balls are kept in position by a cage 145 and afford support to a plate 14*a* matched exactly to the basic tool magazine plate 14. The plate 14*a* has a seat at its center which accommodates the outer ring of a radial-and-thrust bearing 147 held in position by a flange 148. The inner ring of the bearing 147 is integral with a flanged collar 149 ensheathing the first tube 127 in slidable fashion. The flange 128 of the first tube 127 exhibits two alternating sets of radial openings one of which, denoted 154, communicates with the surrounding environment, for reasons which will become apparent, and the other of which accommodating respective flat tool holders 150. The set of openings denoted 154 is also in communication with the annular extractor duct 146, hence the cylindrical stretch which encircles the flange 128, the collar flange 149, and the bearing flange 148, and terminates just short of the matching plate 14*a*. Each tool holder 150 is hinged at bottom near to the axis of the first tube 127, thereby enabling its rotation within the seat, and carries a turning tool disposed normal to the axis of the wire 1. Each tool holder 150 is further associated with a spring 152 at mid-point, and at the outer end of the holder, with a vertical pin 153 which passes through the tube flange 128 and locates against the collar flange 149. Being anchored uppermost to the tool holder 150, and at bottom to the tube flange 128, each spring 152 keeps its relative tool holder continuously in contact with the respective vertical pin 153. Also in this embodiment, one has means 155, represented schematically, for drawing together the plate 139 which is integral with the control sleeve 143 that operates the lower grips 141, and the plate (not shown, but referred to as 139 for convenience) which is integral with the control sleeve 144 that operates the upper grips 142. The lower grips 141, obliged to open following the upward thrust of their control sleeve 143, and the upper grips 142, obliged to open following the downward thrust of their control sleeve 144, are hinged to the respective guides 8 and 11 such that the two sets of grips 141 and 142 will be normally spread by the agency of transverse springs 137*a*, and will close only upon operation of the means 155 aforementioned.

In a further embodiment of the apparatus, not illustrated in the drawings, provision is made for two pairs of plates 21 and 22 with their relative parts, and for one of these pairs of plates 21 and 22 to correspond to one of the embodiments illustrated in FIGS. 3*a*, 3*b*, 3*c* and 3*d*, whilst the other corresponds to one of the other embodiments illustrated in the drawings.

The apparatus also comprises other parts that are not in fact illustrated, such as a control unit and various programming and timing systems, to which some reference will be made during the following explanation of its operation.

In apparatus according to the invention, the wire 1 is uncoiled from the supply reel 2 and routed over its guide roller 54, then through the alignment gate 56 and into the straightening rolls 6, thence between the indexing cylinder 57 and its guide 62, located between the fixed and moving elements 60*a* and 60*b* of the grips mechanism 59, then through the holes in the succession of plates 47, 20, 21, 22 and 33, through the bottom guide 8, tool magazine 14 and top guide 11, between the guide rollers 7, through the oven 12 and the holes in plates 23 and 84, into the wire-drawing gauge 13, between the guide rollers 89 uppermost, then over the final guide roller 87 and around the take-up reel 4.

Threaded up in this way, the wire 1 is either fed continuously or indexed intermittently. In the case of continuous feed, the necessary movement is produced by the pair of guide rollers 7 and the take-up reel 4. Where intermittent feed is adopted, it is the station denoted 5 which indexes the wire, adjustment being made to the length of the stroke by either loosening or tightening the nut 61 provided on the cylinder rod 58; the pair of guide rollers 7 and the take-up reel 4 continue to turn, though in this case the wire 1 is pinched at intervals by the grips 59 at the feed station 5 and thus held stationary. Whatever the type of feed, the guide rollers 7 pull the wire 1 taut, since the supply reel 2 does not free-wheel but is clutch-operated, and induce slight work-hardening. Likewise, whatever the type of feed adopted, it will be observed that the wire 1 could be indexed first through one length and then through another, and so on, thereby permitting of a variety of decorative effects on the wire 1 of a given reel 2, depending on the type of punch 9, shaping rollers 10, cutters 122 or turning tools 151 fitted, and/or on the type of article desired.

Before running the apparatus, the micrometric adjustment screws 24 must be set to suit the gauge of the wire 1 to be crafted. The relevant plate 21 must be released from the pillars 19, loosening the clamp mountings 63 by working their handles 63*a*, whereupon an electrical control signal starts up the motor 25 that turns the screws 24 one way or the other, causing the plate 21 to be drawn closer to or distanced farther from the plate 22 above; this has the effect of allowing movement of the cam follower ball ends 95 through a higher or lower trajectory around the inner surface 17 of the cam ring 15. Since the stroke of the cam followers 94 remains unaltered, this means that the limit positions are altered, though not the reciprocal distance between them. The motor 25 can also be made to turn while the cam ring 15 draws the cam followers 94 together, that is, when the ball ends 95 pass over the relative flat faces 17*a* of the cam ring 15 (see FIG. 4), so as to obtain greater or more progressive penetration of punches 9, shaping rollers 10, cutters 122 or turning tools 151 utilized in shaping and/or decorating the wire 1.

Likewise before the apparatus is set running, the appropriate tool magazine 14 for the decoration envisaged, with its punches 9 (FIGS. 2*b* and 3*a*), or with its shaping rollers 10 (FIG. 3*b*), must be located in the cam ring 15. In the case of the embodiment of FIG. 3*c*, on the other hand, it is sufficient to lock the cutters 122 and their respective spindles 117 in place, and of the embodiment of FIG. 3*d*, to clamp the turning tools 151 in their respective holders 150.

During operation of apparatus as in FIG. 3*b*, rotation of cam ring 15 and of the tool magazine 14 is produced by the motor 18 at one and the same time, though at different relative speeds. The differential must be produced in order that the flat surfaces 17*a* of the cam ring 15 may draw alongside and pass over the ball ends 95 at given intervals, thus causing the shaping rollers 10 to make contact with the wire 1. Since the shaping rollers 10 must follow the surface of the wire 1 in regular fashion during decoration, without sliding contact, and must make at least one turn about the wire 1 with the ball ends 95 riding on the flat surfaces 17*a* of the cam ring 15, appropriate ratios will exist between the pitch diameter of the internal gear teeth 100 in the recessed component 99 and that of the gears 101.

There is no substantial difference between the operation of the embodiment in FIG. 3*c* and the operation of that in FIG. 3*a*; the cam followers 94 produce rotation of the vertical components 115 which carry the independently-driven cutters 122, so as to bring them into contact with the wire 1 at the prescribed intervals.

In the case of the embodiment in FIG. 3*d*, a motor 132 keeps the first tube 127 and the tools 151 in constant rotation. The balls 95 locate on the flat surfaces 17*a* of the cam ring 15, and are urged toward the axis of the apparatus, lifting the matching plate 14*a* of the tool magazine, which in turn pushes up the bearing 147 and the flanged collar 149, producing an upward movement of the pins 153 which, in causing the tool holders 150 to rotate on their pivots, apply the turning tools 151 to the wire. Thus one has relative movement between the workpiece and tool which is the opposite of that normally produced in a conventional lathe. The inclusion of the bearing 147 permits of holding the matched plate 14*a* substantially motionless while the flanged collar 149 rotates at the same high speed as the first tube 127. When no material is being turned from the wire, the means of control denoted 155 release the plates 139, and the grips 141 and 142, under no restraint from their respective control sleeves 143 and 144, are spread by the springs 137*a* and release the wire 1. When applying the tools 151, the means of control 155 are operated so as to draw the plates 139 together, whereupon the grips 141 and 142 close, holding the wire fast.

In passing through the oven 12, the wire 1 undergoes a tempering process which will in some measure remove the work-hardening induced under the action of the punches 9 or the shaping rollers 10.

On exit from the oven 12, the wire 1 is taken back down to its maximum cross-sectional dimension by being drawn through a gauge 13. Shaping and/or other decoration will produce enlargements in the section of the longitudinal member such as would prevent a subsequent stage in automatic machinery from being carried out; such machines must in fact receive wire strictly to constant maximum gauge specification in order to operate correctly.

Whether fed continuously or indexed, the wire can in addition be made to rotate about its own axis together with the two reels 2 and 4 and the guide rollers 7, since the rings 26, 27 and 108 which carry the reels 2 and 4 and the rollers 7 can all be made to turn synchronously.

With reference to FIGS. 5–12*b*, which illustrate just some of the decorative effects 3 which can be produced with an apparatus as described, it will be seen that the decoration 3 of FIGS. 5, 6 and 7, and that of FIGS. 9–12*b* are produced without rotating the wire about its axis, whereas the decoration 3 in FIG. 8 is produced by rotating the wire. The decoration of FIG. 5 is produced with a punch 9 designed to leave a diamond impression 3. The decoration 3 as in FIGS. 6 and 7 is produced with punches 9 utilized in pairs, though whereas in the case of FIG. 6 two pairs of under-and-under punches 9 are required, in that of FIG. 7, the pairs punches 9 lie in the same plane and are offset 90° one from the other. The decoration 3 in FIG. 8 is produced with one pair of punches 9 only, the wire itself being rotated as aforesaid; it will be observed however, that if the wire is fed through continuously, the punches 9 must be angled relative to the axis of the wire with respect both to the linear and to the angular of the wire 1. The decoration 3 in FIG. 9 is produced with five pairs of punches 9, three of which parallel under-and-over, the remaining two located intermediate and offset at 90° with respect to the first three. The decoration 3 in FIGS. 10*a* and 11*a* is produced with apparatus as in FIG. 3 designed to roll-form the wire 1; for the first of the two examples, a single pair of opposed shaping rollers 10 would be employed, whereas in the second example, three pairs 10 would be needed. The decoration 3 in FIG. 12*a* is a combination of the decoration 3 in FIG. 9 and two of the effects as in FIG. 10*a*, and would be obtained utilizing apparatus, according to the invention, combining the embodiments of FIGS. 3*a* and 3*b*, respectively.

To obtain decorative effects 3 as illustrated in FIGS. 5–9 and 10*a*, 11*a* and 12*a*, one departs from a given section which, shaped by deformation with the use of punches 9 or rolls 10, becomes enlarged at a given point, or points 126, enhancing the design.

To obtain the decorative effects 3 in FIGS. 10*b* and 11*b*, wire with a given transverse dimension is utilized, from which material is turned off with the lathe type tools 151, producing a different end-result in visual terms that reduces the dimensions of the wire overall.

The decoration 3 in FIG. 12*b* is produced using apparatus which incorporates the embodiment of FIG. 3*c* at bottom, and the embodiment of FIG. 3*a* uppermost; an initial flattening pass is made with the cutters 122, whereupon impressions are made in exactly the same spot either side utilizing punches 9.

FIG. 13 shows a pair of chain links obtained by decoration of a wire 1 with apparatus according to the invention, and bending those parts which remain undecorated. In this instance there has been no shaping such as would favor subsequent bending; rather, the important feature is that the decoration 3, which is of the type illustrated in FIG. 9, has been carried out at a constant indexed length in order to permit subsequent shaping of the pre-decorated wire 1 by a separate automatic machine.

The precision required for carrying out these types of decoration 3 will appreciated from FIG. 14, which illustrates that part of the link where the two ends 160 of the modular unit are joined. The decoration in this case has been produced by removing minute quantities of material, utilizing cutters 122, with the wire 1 rotating about its own axis. It must be borne in mind in this instance, that the saw which cuts through the wire 1 to separate the modular units one from the next, will be of a certain thickness, and that when the two ends of the link are matched, the decoration which has been sawn through must be faultlessly rejoined.

The embodiment described is just one of the many possible, according to the invention. It would be possible, for instance, without straying from within the scope of the claims, to move the plates 21 and 22 and hold the wire 1 still, or not to rotate the wire 1, or again, to work on discrete lengths of wire 1.

What is claimed:

1. A method for automatic shaping/decoration of longitudinal members in modular units of preset size from which ultimately to fashion articles of jewelry in precious metal or articles of costume jewelry, an essential feature of which is that it comprises the following steps:

(a) support, tensioning and guiding of the longitudinal member through and along its own longitudinal axis;

(b) shaping/decoration of the longitudinal member at or along successive stretches thereof lying between the supports, by tools located around the longitudinal member and independently driven so as to operate simultaneously and at irregular intervals of time at points located along a plane perpendicular to the axis of the said longitudinal member, in such a way as to keep the said member perfectly steady along its axis, during the said shaping/decoration;

(c) autonomous, motor-driven and clutch-controlled advance movement of the longitudinal member, along its own longitudinal axis, in such a way as to keep constantly and firmly tensioned the longitudinal member, including during the said shaping-/decoration;

(d) application of a first heat treatment to the longitudinal member by tempering in a controlled atmosphere;

(e) gauging of the longitudinal member to a maximum constant cross-section;

(f) recoil of the longitudinal member around a take-up reel.

2. Method as in claim 1 wherein means for guiding the longitudinal member according to step a are located at either side of and immediately adjacent to the said tools.

3. Method as in claim 1 wherein the longitudinal member, during the said advance movement, rotates around its longitudinal axis too.

4. Method as in claim 1 wherein the said advance movement takes place at irregular intervals of time.

5. Apparatus for automatic shaping/decoration of longitudinal member in modular units of preset size from which ultimately to fashion articles of jewelry in precious metal or articles of costume jewelry, essential features of which are that it comprises:

means of supporting, tension and autonomous motor-driven and clutch-controlled advance movement of the longitudinal member, that also comprises at least one interchangeable clutch-controlled supply reel from which the longitudinal member is paid out in annealed state, and one interchangeable motor-driven and clutch-controlled take-up reel;

an intermittent feed unit of the longitudinal member, located downwards said supply reel which, if activated, irregularly interrupts the longitudinal member feed, that is constantly tensioned owing to the draw exerted thereupon by the said take-up reel;

means for straightening the longitudinal member;

means of shaping/decoration acting (simultaneously) on the longitudinal member, provided with tools supported around the longitudinal member by means of an interchangeable tool magazine containing a single cam and are operated by a cam ring in shaping/decorating the longitudinal member; and wherein the relative positions of the cam ring and the magazine can be adjusted to suit the gauge or thickness of the longitudinal member and/or the depth of the shaped and/or decorative effect, means for guiding the longitudinal member located at either side of and immediately adjacent to the said tools; an oven featuring operation in controlled atmosphere, designed to temper the longitudinal member initially following work;

hardening induced therein by the said tools, in order to allow a subsequent and damage-free recoil of the longitudinal member into the said take-up reel; and a drawing gauge designed to restore the longitudinal member to its maximum cross-section.

6. Apparatus as in claim 5 wherein the said tools consist of one or more pairs of opposite punches.

7. Apparatus as in claim 5 wherein the said tools consist of driven shaping rollers carried by cam followers contacting the said cam which induce slight work-hardening in the longitudinal member.

8. Apparatus as in claim 7 wherein each shaping roller is keyed to an idle spindle, carried to said corresponding cam follower which turns around the longitudinal member, and wherein a gear likewise keyed to the idle spindle meshes with internal gear teeth that are fixed in relation thereto.

9. Apparatus as in claim 5 wherein the said tools consist of independently driven rotary cutters.

10. Apparatus as in claim 9 wherein said cutters are mounted to independently driven spindles carried by respective hinged components that are pivotably rotated towards and away from the longitudinal member by the said cam.

11. Apparatus as in claim 5 wherein the said tools are lathe-type turning tools.

12. Apparatus as in claim 5, wherein the said tools are lathe-type turning tools that are carried by respective tool holders which rotate independently about the longitudinal member; and wherein said means for guiding the longitudinal member consist of gripping means adjacent to the turning tools which hold the longitudinal member fast while the tools are at work thereon, and release the member when the tools are distanced therefrom.

13. Apparatus as in claim 5 wherein the said tools can be drawn together and set apart through a path normal to the axis of the longitudinal member when the member is indexed intemittently, and wherein said tools are angled into the path of movement of the longitudinal member when the member is fed continuously.

14. Apparatus as in claim 5, wherein said cam ring is rotatable about the magazine and exhibits working surfaces which are angled in relation to the axis of the longitudinal member.

15. Apparatus as in claim 14 wherein the transmission ratio between the gears and the internal gear teeth is such that the shaping rollers, when engaging the longitudinal member, complete at least one full turn therearound with no sliding contact produced.

16. Apparatus as in claim 14 wherein the length of the teeth of the gears and the length of the internal gear teeth are such that a constant mesh is ensured when the gears are drawn closer together or spaced farther apart.

17. Apparatus as in claim 5, comprising at least one pair of parallel pillars locked in position at either end, to which at least one plate is fitted in adjustable fashion in order to carry the said means of supporting, tensioning and autonomous motor-driving and clutch-controlling advance movement, the said intermittent feed unit and said straightening means, and to which another plate is fitted in order to carry the said oven, the said drawing gauge and the said take-up reel, and wherein further tensioning means are mounted to a vertical bracket carried by a further plated fitted to the pillars and adjustable thereon and disposed downwards said tools.

18. Apparatus as in claim 17 wherein the plates carry their respective components by way of relative first, second and third flat bolted plates which can be motor-driven, in such a way as to rotate the longitudinal member around its longitudinal axis.

19. Apparatus as in claim 5 comprising at least one pair of parallel pillars locked in position at either end, to which a plate is fitted in adjustable fashion in order to carry the interchangeable tool magazine, and to which a further plate is fitted in order to carry the cam ring and its prime mover; wherein means located between the two plates permit of altering and adjusting the position of the one plate in relation to the other.

* * * * *